United States Patent [19]

Inagaki et al.

[11] 4,255,691

[45] Mar. 10, 1981

[54] SHOCKPROOF ELECTRONIC FLASH DEVICE

[75] Inventors: Tetsuhiko Inagaki; Toshinori Imura, both of Sakai, Japan

[73] Assignee: Minolta Camera Kabushiki Kaisha, Osaka, Japan

[21] Appl. No.: 33,788

[22] Filed: Apr. 27, 1979

[30] Foreign Application Priority Data

Apr. 29, 1978 [JP] Japan ..... 53-51907

[51] Int. Cl.[3] ..... H05B 41/32

[52] U.S. Cl. ..... 315/241 P; 328/7; 331/63; 354/145

[58] Field of Search ..... 315/241 P; 320/1; 354/64, 126, 145, 288; 328/7; 331/63; 361/397, 399; 174/5 R

[56] References Cited

U.S. PATENT DOCUMENTS 3,711,741 1/1973 Akiyama et al. ..... 315/241 P 4,153,357 5/1979 Winnacker et al. ..... 354/64

*Primary Examiner*—Eugene R. LaRoche

*Attorney, Agent, or Firm*—Wolder, Gross & Yavner

[57] ABSTRACT

An electronic photoflash device includes a high voltage DC generator, a main storage capacitor and a reflector backed photoflash tube unit mounted on an insulating substrate on which are printed a high voltage conductor line connecting first terminals of the generator, capacitor and tube and a ground conductor line connecting their opposite terminals. The ground line surrounds and is proximate the high-voltage line so that the deposition of water on the substrate extends between and short-circuits the lines to discharge the high-voltage and eliminates the risk of an electric shock to the device operator. Alternative arrangements may be provided for surrounding the high-voltage conductor with the ground conductor, the conductors having proximate bare portions bridged by a surface which, when moistened, short circuits the conductors.

11 Claims, 4 Drawing Figures

SHOCKPROOF ELECTRONIC FLASH DEVICE

BACKGROUND OF THE INVENTION

The present invention relates generally to improvements in electronic photoflash devices and it relates more particularly to an improved electric shockproof electronic flash device for use in photography.

In general, the conventional electronic photoflash device whether separate from or incorporated in a camera body employs a high voltage direct current, so as to produce an electric gas discharge in a flash tube. This high voltage for use in such an electronic flash device includes a DC to DC voltage step-up convertor or network for raising the voltage of a DC electric current supplied from a low voltage power source such as a battery and storing the stepped-up voltage in a storage capacitor. With such an arrangement, the high voltage direct current is stored in the internal circuit or storage capacitor while the flash device is switched on. Such an electric network is generally disposed internally of the flash device in a manner to be electrically insulated from the exterior thereof, for the operator's protection so that the likelihood of the high voltage reaching the exterior is minimized.

However, should water enter or penetrate such a flash device, a current would flow from the high voltage portion of the insulating substrate on which the electric circuit is printed, to an external portion of the device due to the electrical conductivity of the penetrant water thus imparting a high voltage to these external portions which are also rendered conductive, with a resulting high risk that a large current may be discharged into the body of an operator, if the operator touches the high potential external portion of the flash device. Such occurrence or accident may occur even with a water-proof flash device or a water-proof camera having a self-contained flash device, although such a flash device or camera is designed as to be protected against the penetration of any water. However, while used in water or in rain, such a water-proof flash device or water-proof camera is likely to be moistened with water which diffuses into or otherwise penetrates the device or camera leading to the aforesaid type of accident. Accordingly a structure which eliminates the possibility of the high voltage of an electronic photoflash network from reaching the accessible exterior is highly desirable.

An electronic flash device equipped with an electric shock preventive mechanism has heretofore been commercially available. This commercially available type electronic flash device includes a pair of mutually spaced metallic plates disposed in a suitable or desired portion in the photoflash device, such as at the rear of the photoflash reflector and a discharge network for causing the discharge of electric energy from the main photoflash capacitor is also included in the photoflash network with actuating terminals therefor connected to respective metallic plates. With such a device, in the event that water penetrates into the photoflash device, then two metallic plates are short-circuited by the water to actuate the discharge network, thus causing the discharge of electric energy stored in the main capacitor and the operator is thus protected from electric shock.

However, with the aforesaid structure in which water entering the device is detected by a pair of spaced metallic plates, the photoflash device possesses the drawback in that in the event of water entering the photoflash device through portions having no sensing metal plate, the discharge circuit remains unactuated. Furthermore, such a device requires the pair of metal plates for detecting the presence of water as well as a special circuit for effecting the discharge of electric energy from the main storage capacitor, resulting in a complex construction and a costly device.

SUMMARY OF THE INVENTION

It is accordingly a principal object of the present invention to provide an improved electronic flash device equipped with an electric shock preventing mechanism.

It is another object of the present invention to provide an improved shockproof electronic photoflash device, wherein in the event of water entering the device through any portion thereof, any risk of an operator being exposed to a high voltage is eliminated.

It is a further object of the present invention to provide an improved shockproof electronic flash device which is highly reliable, simple in construction and less costly to manufacture.

The above and other objects of the present invention will become apparent from a reading of the following description taken in conjunction with the accompanying drawings which illustrate preferred embodiments thereof.

DESCRIPTION OF THE PREFERRED EMBODIMENTS

Figure 1:
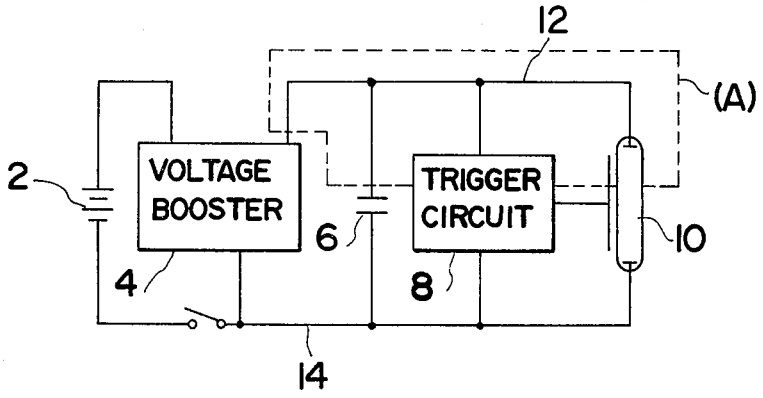
FIG. 1 is a block diagram of an electric circuit incorporated in an electronic flash device according to the present invention.

Referring to FIG. 1 which is a block diagram of an electric circuit, for a simple explanation of the principle of the present invention, a main storage capacitor 6, a photoflash tube trigger circuit 8, and a photoflash tube 10 have respective first terminals thereof connected to the high voltage output terminal of a voltage booster circuit 4 by way of a high voltage line 12, the input terminal of the booster circuit 4 being connected to the positive side of a direct current source 2 of the photoflash circuit in the known manner. To the negative side of direct current source 2 and voltage booster circuit 4 are connected the other or second terminals of main capacitor 6, trigger circuit 8 and a flash tube 10 by means of a low voltage or ground line 14. Voltage booster circuit 4 is constructed to convert direct current into alternating current, raise the voltage of alternating current and then convert or rectify the high voltage AC into a high-voltage direct current. The high-voltage direct current from voltage booster circuit 4 charges main capacitor 6, so as to permit the adequate and proper supply of electric energy to flash tube 10. Trigger circuit 8 causes flash tube 10 to discharge, and is so arranged as to be actuated by a switch interconnected with the shutter mechanism of a camera, so as to ignite or trigger the flash tube in association with the picture-taking operation.

A circuit A enclosed by a broken line in FIG. 1 comprises the high-voltage output line 12 to which high voltage is applied. An important feature of the present invention resides in that the low-voltage line 14 is disposed along the peripheral portion or in the vicinity of the bare portion of the high-voltage line.

Figure 2:
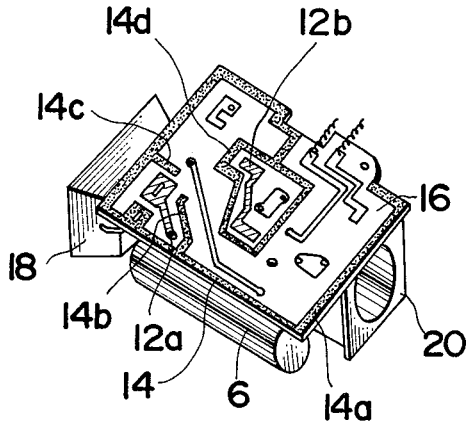
FIG. 2 is a perspective view of an electronic flash device of a first embodiment of the present invention.

FIG. 2 shows an insulating substrate 16 on which the flash circuit of FIG. 1 is printed and to which are attached a reflector or reflecting shade 18 for flash portion or tube 10, main capacitor 6 and a cell box 20 for housing a battery 2 serving as the power source.

Of the conductors printed on substrate 16, the conductor which is dotted represents low-voltage line 14, and the conductors which are hatched represent high-voltage output lines 12. Low-voltage line 14 consists of a main line 14*a* extending along the circumferential border of substrate 16 in a manner to substantially entirely surround or enclose high-voltage output line 12, branch lines 14*b* and 14*c* extending from the main line to the vicinity of high-voltage output line 12*a*, and a line 14*d* fully surrounding or enclosing a second portion 12*b* of the high-voltage output line.

Figure 3:
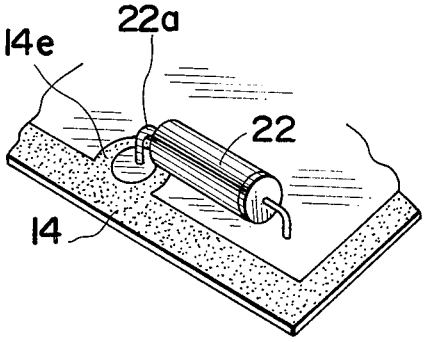
FIG. 3 is a fragmentary perspective view of an essential part of an electronic flash device of another embodiment of the present invention.

FIG. 3 is a fragmentary perspective view of substrate 16 of an embodiment of the invention in which resistor 22 is attached to substrate 16 in the manner shown in the drawing. Low-voltage line 14 with a conductor loop 14*e* integral therewith and extending therefrom is printed on the substrate and encloses a high-tension side terminal or lead 22*a* of resistor 22.

The high-voltage output line 12 being surrounded by low-voltage line 14*a*, in the event that water enters into the photo-flash device and contacts the high-voltage line, the water flows or is deposited on the substrate into contact with any portion of the low-voltage line, so that the high-voltage line and the low-voltage line are short-circuited to each other, thereby allowing the discharge of electric energy within the circuit.

Owing to low-voltage lines 14*b*, 14*c* and 14*d* surrounding the high-voltage lines, if water drops or flows from a member provided above the substrate to contact the high-voltage line, then such water necessarily contacts any of low-voltage lines 14*b*, 14*c* and 14*d*, whereby the high-voltage output line and any of the low-voltage lines are short-circuited to cause the main capacitor to discharge electric energy therefrom within the circuit, thus eliminating the risk of an operator being exposed to a high voltage.

By providing low-voltage line 14 in the vicinity of high-voltage output line 12 in a matter to substantially enclose line 12, should water enter into the electronic flash device and moisten the substrate, then the high-voltage output line and the ground or low-voltage line become conductively coupled due to the water, whereby electric energy stored in the main capacitor discharges within the circuit, thus eliminating the risk of electricity passing to the exterior of the electronic flash device hazzarding an electric shock to the operator.

If, in the preceding embodiments, the electric elements constituting voltage booster 4, main capacitor 6 and trigger circuit 8, and high-voltage output line 12 are coated with an electrically insulated, water-proof material, such as a silicone rubber or wax, so as to resist water, there results an improved electric-shock preventing characteristic. The low-voltage line and the high-voltage output line are not necessarily printed on the substrate, but may be the conductors in general use, with the same results as described above.

In the case where the high-voltage output line is coated with an electrically insulating material, as described, with part thereof uncovered, a low-voltage or ground wire may be wound on the high-voltage output line in the portion covered with an electrically insulating material and close to the uncovered portion thereof, with the same electric-shock preventing properties as described above. As an alternative, an uncovered portion of the high-voltage output line may be emcompassed in an unmodified fashion by an electrically conductive cover electrically connected to the low-voltage line.

Figure 4:
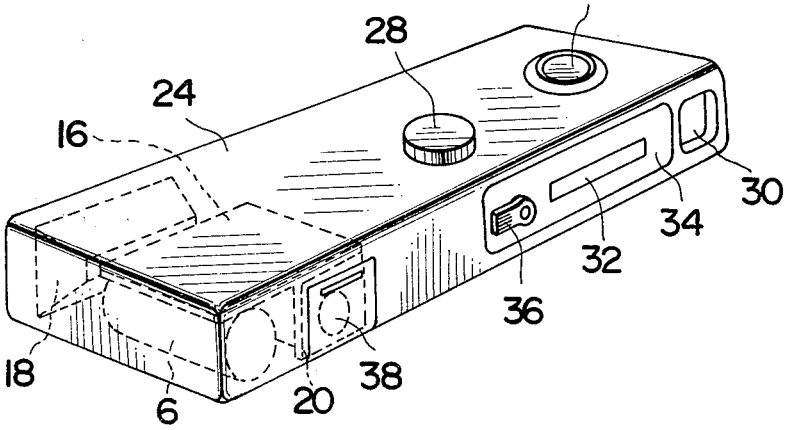
FIG. 4 is a perspective view of a water-proof camera containing the electronic flash device shown in FIG. 2.

Referring now to FIG. 4 which is a perspective view of the electronic flash device of FIG. 1 shown by a broken line as incorporated in a water-proof camera of the type using a 110 size film, the flash tube reflector 18, main capacitor 6 and cell box 20 are attached to substrate 16 of the electronic flash device in the manner described above, and the low-voltage line is printed on the substrate to surround the high-voltage output line in close proximity thereto. The electronic flash device is housed in the outer casing 24 of the camera. The outer casing 24 is made of an electrically insulating synthetic resin and has a water tight structure. Provided on the top surface of the camera are a shutter button 26 and an exposure adjusting knob 28. On the rear face of the camera, there are provided an ocular window for a view finder 30, a rear lid 34 provided with a film-counter window 32, a lock lever 36 for the rear lid, and a lid 38 for the cell box 20 in the order described, as viewed from the right to the left in FIG. 4. In the front surface of the camera (not shown), there are provided a photo-flash window, an objective lens, a view-finder window and a light-receiving window for a light measuring element.

Respective portions of the camera are of a watertight construction. For example, the poprtion of the camera casing on which the shutter button is mounted is hermetically covered with rubber, so as to prevent any water ingress therein. An O-ring engages the shaft of exposure adjusting knob 28 rotatably mounted to and entering the camera casing, so as to prevent ingress of water into the camera body. Cell lid 38 and rear lid 34 are lined with rubber packing along the edges thereof.

In the event that, during the service of such a water-proof camera in water or in rain, water enters or penetrates into the outer casing of the camera and moistens the electronic flash device incorporated in the camera, then the high-voltage output line and the low-voltage line are short-circuited, so that electric energy stored in main capacitor 6 discharges therefrom within the circuit rather than passing to the exterior of the camera by way of such water, and hence the camera operator is not likely to be shocked or electrically affected.

According to the present invention, since the low-voltage line surrounds the high-voltage output line in close proximity thereto, in the event that water enters the electronic flash device and moistens the high-voltage output line, the high-voltage output line becomes short-circuited to the low-voltage or ground line, whereupon electric energy stored in the main capacitor discharges within the circuit, with no likelihood of being leaked to the exterior of the camera casing, and hence ensuring the safety of an operator.

By printing the high-voltage output line and the low-voltage line on the substrate, a pattern is easily produced in which the high-voltage output line is encompassed by the low-voltage line as shown in the illustrated embodiments. It is of advantage that the electric circuit of the electronic flash device is covered with a water-proof, electrically insulated material, such as a silicone rubber or wax, in order to achieve the perfect sealing as well as insure the increased safety of the operator.

While there have been described and illustrated preferred embodiments of the present invention, it is apparent that numerous alterations, omissions and additions may be made without departing from the spirit thereof.

We claim:

1. An electronic photoflash device comprising a direct current high-voltage source including a high-voltage terminal and a ground terminal, a main storage capacitor including a high-voltage terminal and a ground terminal, a photoflash tube including a high-voltage terminal and a ground terminal, means including a first conductor interconnecting said high-voltage terminals and means including a second conductor connecting said ground terminals and characterized in that said second conductor includes a portion which substantially encompasses and is proximate at least a portion of said first conductor and a surface extending between said conductor portions whereby the deposition of water on said surface effects the short-circuiting of said conductors and the discharge of said capacitor.

2. The electronic photoflash device of claim 1 including an insulating substrate, said first and second conductors being printed on said substrate.

3. The electronic photoflash device of claim 2 wherein said second conductor extends along the peripheral border of said substrate for a major portion of the length thereof and said first conductor is located within the area delineated by said second conductor.

4. The electronic photoflash device of claim 2 wherein said first conductor includes a section spaced inwardly of the border of said substrate and said second conductor includes a branch substantially surrounding said first conductor section.

5. The electronic photoflash device of claim 2 wherein said capacitor, photoflash tube and said voltage source are mounted on said substrate.

6. The electronic photoflash device of claim 2 including an electrical component mounted on said substrate and having a high-voltage lead extending to a face of said substrate, said second conductor including an annular portion surrounding said lead at said substrate face.

7. An electric device comprising a casing and an electronic flash circuit structure incorporated therein, said circuit structure including an insulating substrate, a high voltage line to which a high-voltage is applied and a low-voltage line surrounding said high-voltage line, said high-voltage and low-voltage lines including conductors printed on said substrate.

8. An electric device as set forth in claim 7, wherein said low-voltage line includes a surrounding portion extending along the peripheral border of said substrate and an auxiliary portion positioned in close proximity to said high-voltage line.

9. An electric device as set forth in claim 8, wherein said auxiliary portion completely surrounds said high-voltage line.

10. An electric device as set forth in claim 7, wherein said casing includes a water-proof housing.

11. An electric device as set forth in claim 10, wherein said water-proof housing includes a camera body in whcih a camera mechanism is disposed.

* * * * *